US005794580A

United States Patent [19]

Galletti

[11] Patent Number: 5,794,580

[45] Date of Patent: Aug. 18, 1998

[54] REMOTE START/STOP SYSTEM FOR MAGNETO IGNITION ENGINES

[75] Inventor: Joseph Galletti, Austin, Tex.

[73] Assignee: Remote Products Inc., Austin, Tex.

[21] Appl. No.: 805,635

[22] Filed: Feb. 26, 1997

[51] Int. Cl.[6] ..... F02N 11/08

[52] U.S. Cl. ..... 123/179.2; 290/37 R

[58] Field of Search ..... 123/179.2, 179.3, 123/179.4, 179.5; 290/37 R

[56] References Cited

U.S. PATENT DOCUMENTS

| | | | |
|---|---|---|---|
| 2,400,216 | 5/1946 | Smith | 290/37 R |
| 2,444,460 | 7/1948 | Moncrief | 123/179.2 |
| 3,054,904 | 9/1962 | Fuciarelli | 290/37 R |
| 4,577,599 | 3/1986 | Chmielewski | 123/179.2 |
| 5,601,058 | 2/1997 | Dyches et al. | 123/179.2 |

*Primary Examiner*—Andrew M. Dolinar

*Attorney, Agent, or Firm*—Kokjer, Kircher, Bowman & Johnson

[57] ABSTRACT

A remote control system for starting and stopping an engine with a magneto ignition. A radio frequency transmitter transmits alternating start and stop signals to a receiver/controller. When a start signal is received, the receiver/controller autonomously provides two outputs, one of which actuates a latching relay and the other of which is a timed pulse having a set duration. The pulse activates another relay which applies power to the start solenoid for starting the engine. A third relay cooperates with the other two relays to maintain the proper conditions and sequences of the operational systems of an engine with a magneto ignition to start the engine, thereafter allow it to run, and stop it when a subsequent signal is transmitted to the receiver/controller.

20 Claims, 2 Drawing Sheets

REMOTE START/STOP SYSTEM FOR MAGNETO IGNITION ENGINES

FIELD OF THE INVENTION

This invention relates generally to the field of engines with a magneto ignition and deals more particularly with a system for remotely starting and stopping engines with magneto ignition systems.

BACKGROUND OF THE INVENTION

Small engines with magneto ignition are widely used in a variety of applications in industrial and service industries. Most of the applications for engines with magneto ignition systems are those where cost and/or weight requirements make battery ignition impractical, or where batteries are undesirable for some other reason. By way of example, magneto style ignitions are commonly used as the ignition system on internal combustion engines used to power lawn mowers, pumps and compressors. Typical applications are for welding machines, painting systems, pressure washers, insecticide pumps, lawn chemical pumps, portable hydraulic pumps, carpet cleaning systems and machines for blowing insulation.

Engines with a magneto ignition have a manually controlled start, run and kill system which often takes the form of a key operated multi pole electric switch, or ignition switch. Manual start/stop control requires the operator to be physically present at the engine location in order to turn it on and shut it off. While this is sometimes acceptable, there are many situations involving the use of this type of equipment in which the operator is stationed a considerable distance away from the engine. Under those circumstances, it is inconvenient, inefficient, and possibly unsafe to require the operator to move from his remote location to the engine location each time he needs to start or stop the engine, and to then return to his work location.

Battery ignition systems are relatively easy to control remotely. For example, automobile engines are commonly controlled by remote control systems. However, because remotely controlling engines with a magneto ignition is much more difficult, practical commercial systems for that purpose have not been available. The stopping of an engine with a magneto ignition is not a particularly complicated operation, but using a magneto ignition system to start an engine requires a number of steps that must be carried out in a prescribed sequence.

Specifically, the magneto ignition circuit and the regulator/rectifier circuit of the ignition system must be disconnected from each other and from a grounded condition or the magneto ignition circuit must be disconnected from a grounded condition and the regulator/rectifier must be in the unpowered condition. The fuel shut-off solenoid must be supplied with power during starting of the engine and while it is running. The start solenoid must be supplied with power while the engine is being started, but it must thereafter be disconnected from the power supply after the engine has been started and is operating. Finally, the regulator/rectifier must be supplied with power once the engine is running.

Because of the complexity of this sequence, remote control systems for starting and stopping engines with a magneto ignition have not been commercially available. Attempts at remotely controlling equipment of this type are also complicated by additional difficulties, including the problem of transmitting effective control signals over the necessary distance and through potential barriers, and the need to provide a control device that when triggered provides an autonomous response that is simple in operation and does not require a complicated sequence of button activation, modulated by the operator, in order to work properly. Another requirement of a remote control system is to avoid interference from extraneous signals, including those from CB radios, airborne radio signals, and signal overlap when there are two or more operators working side by side or otherwise in close proximity to each other.

SUMMARY OF THE INVENTION

The present invention is directed to a remote control system which reliably starts and stops engines with a magneto ignition from a remote location through a single momentary press of a transmitter button. This is accomplished by providing a specially designed control circuit which accurately, repeatably, and autonomously carries out the complicated series of steps, in the proper sequence, that are necessary for the starting of an engine with a magneto ignition. The system is characterized by effective control up to hundreds of feet away from the engine, by the ability to operate over long distances even when there are intervening barriers, by digital coding in order to avoid false activation by stray signals that might be present, by the ability to autonomously control the complete start and stop operation, by full operational control from a single unmodulated press of the transmitter button, by the ability to be wired in several configurations to accommodate the inclusion or exclusion of the ignition switch as an active component necessary in the invention, and by simple and cost effective operation.

In accordance with the invention, a radio frequency transmitter and receiver are matched by digital coding which allows the receiver to validate only signals from the matched transmitter and to reject extraneous or stray signals from other sources, including other nearby transmitters.

In the embodiment where the ignition switch is not an active component in the control circuit, when a valid signal is received to start the engine, a latching circuit in the control circuitry is activated to maintain a relay energized. The relay then disconnects the magneto and the regulator/rectifier from each other and from ground or disconnects the magneto from ground and leaves the regulator/rectifier in an unpowered state. Another signal provided by the control circuitry is a pulse signal that is timed to remain active for an adjustable time period, typically between one and twenty seconds. The pulse activates another relay which applies power to the start solenoid of the ignition system long enough for the engine to start, after which the start solenoid is deenergized. A third relay is activated whenever the relay of the latching circuit is activated, and the fuel shut-off solenoid then receives power to allow the engine to start and then run. When the pulse signal disappears after the timing period has elapsed, the regulator/rectifier is supplied with power through the relay of the latching circuit and the now deenergized second relay.

In the case when the ignition switch is an active component in the control circuit; the regulator/rectifier and the fuel shut-off solenoid are in the powered state. When a valid signal is received to start the engine, a latching circuit in the control circuit is activated to maintain a relay energized. The relay then disconnects the magneto from ground. Another signal provided by the control circuitry is a pulse signal that is timed to remain active for an adjustable time period, typically between one and twenty seconds. The pulse activates another relay which applies power to the start solenoid of the ignition system long enough for the engine to start, after which the start solenoid is deenergized.

In the case when the ignition switch is not an active component in the control circuit, a subsequent signal from the transmitter causes the control circuitry to deenergize all relays. The magneto and the regulator/rectifier are then connected to one another and with ground or the magneto is connected to ground and the regulator/rectifier is left in an unpowered state, and the fuel shut-off solenoid is disconnected from power so that the engine stops.

In the case when the ignition switch is an active component in the control circuit; a subsequent signal from the transmitter causes the control circuitry to deenergize all relays. The magneto is then connected to ground.

Alternating signals serve as alternating start and stop signals to provide simple control of the engine from a remote location without the need to activate numerous buttons or the like in a prescribed coded sequence.

The duration of any and all radio transmissions generated by pressing the transmitter button is momentary and confined to preset, preprogrammed times. The carefully timed and complex operation of the start/stop control circuitry is autonomous and unmodulated by the operator. The single press of the transmitter button causes the autonomous operation of the start/stop circuitry.

BRIEF DESCRIPTION OF THE DRAWING

Drawing 1 is a schematic diagram of a control circuit for a remote control system for a magneto ignition engine which is constructed according to a preferred embodiment of the present invention.

Drawing 2 is a subset of drawing 1 where the ignition switch is an active component of the control circuit described in drawing 1.

DETAILED DESCRIPTION OF THE INVENTION

Figure 1:
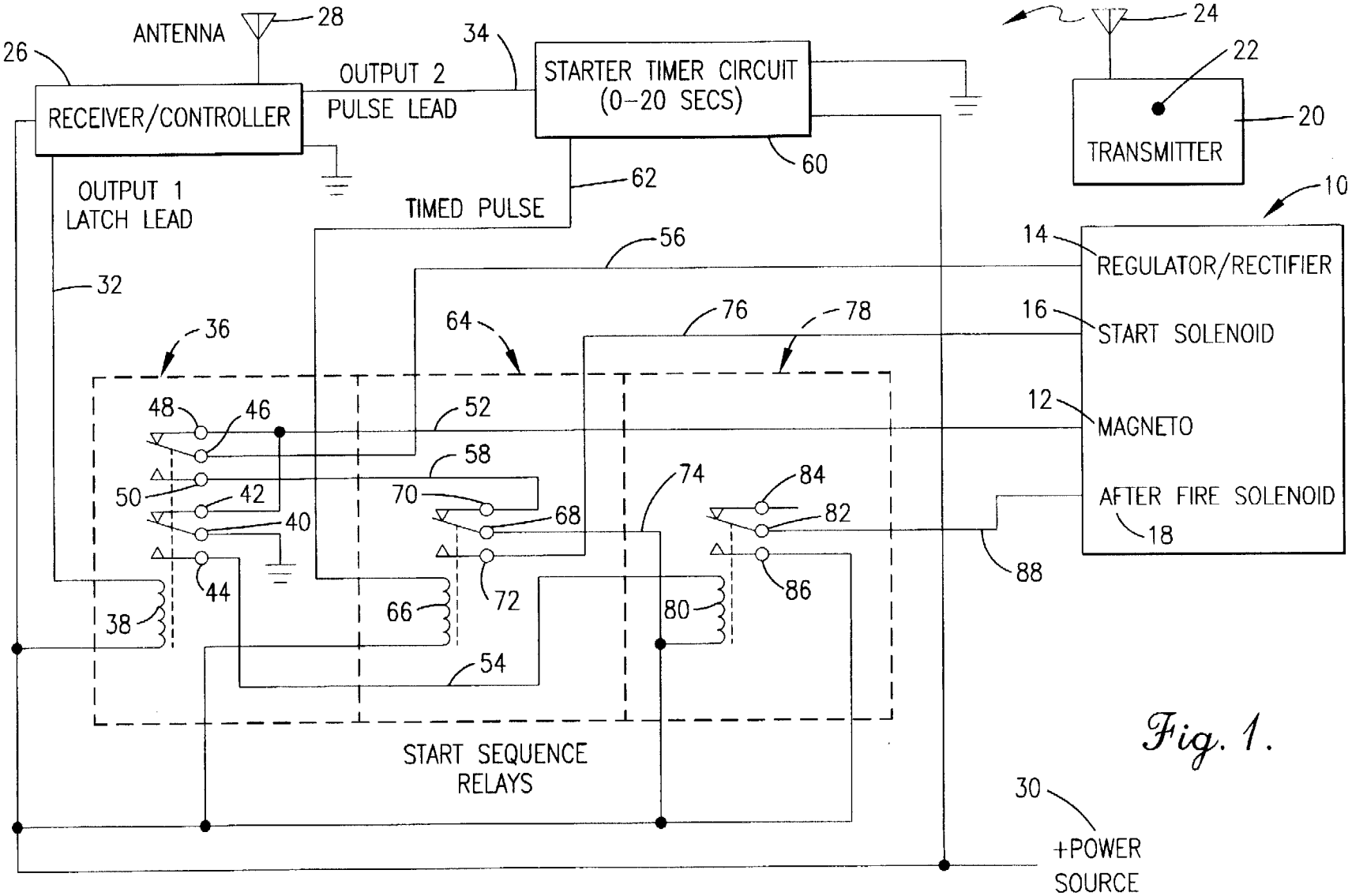
Figure 2:
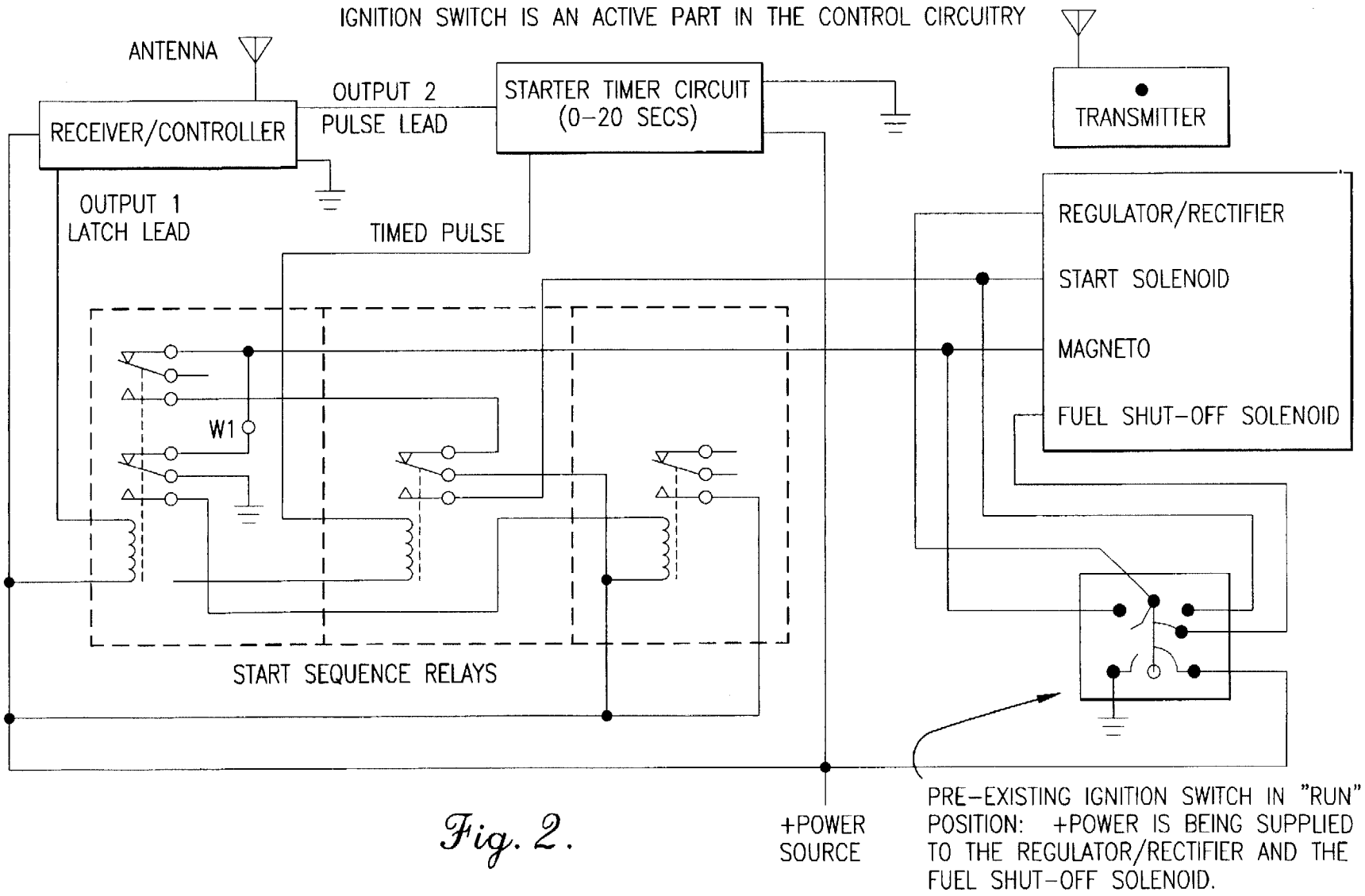

The present invention is directed to a system for controlling an engine with a magneto ignition. The operational systems of an engine with a magneto ignition are generally identified by numeral 10 and which are used to start, stop, and operate a conventional internal combustion engine (not shown). The operational systems of an engine with a magneto ignition 10 may be a conventional system having the usual components, including a magneto 12, a regulator/rectifier circuit 14, a start solenoid 16, and an fuel shut-off solenoid 18. Starting of the engine requires that the operational systems of an engine with a magneto ignition 10 be controlled through a prescribed series of steps, as will be explained more fully.

In accordance with the present invention, a radio frequency transmitter 20 transmits pulsed digitally encoded radio frequency signals when the transmitter is activated (i.e., buttons pressed). This is as opposed to a continuous stream of digitally encoded radio frequency signal, from a transmitter that is "on" all the time. By way of example, the transmitter 20 may be provided with a button 22 such that an encoded rf signal is transmitted upon each depression of the button 22. The transmitter 20 may be equipped with a suitable antenna 24.

The signals that are transmitted by the transmitter 20 are received by a receiver/controller 26 having an antenna 28. The transmitter 20 and receiver/controller 26 are matched to one another through the digital encoding of the signals from the transmitter 20. The receiver/controller 26 is able, through the digital coding scheme, to analyze each signal that is received and to validate only those signals that are emitted from the matched transmitter 20. In this way, only valid signals from the transmitter 20 are effective to activate the receiver/controller 26. The transmitter 20 is unable to modulate the output of the receiver/controller 26 other than to alternately activate the preprogrammed start and stop sequences of operation.

The receiver/controller 26 is connected with and forms part of a control circuit which includes a power source 30 connected with the receiver/controller 26 to supply it with operating power. The receiver/controller 26 has two outputs, one of which is applied to a first output line 32 and the other of which is applied to a second output line 34. The output signal on line 32 is a latching signal which is applied to a relay generally identified by numeral 36. Relay 36 may conveniently be a double pole, double throw relay. Alternating signals from the transmitter 20 cause the output line 32 to alternate between an active and an inactive condition. In the active condition, line 32 is in a negative condition and a circuit is then completed from the power source 30 to line 32 through a relay coil 38 which is the coil for relay 36.

In the case when the ignition switch is not an active component in the control circuit, the drawing shows relay 36 in the deenergized condition of coil 38. In this condition, contacts 40 and 42 are connected with each other, and contact 40 is disconnected from contact 44. Similarly, contacts 46 and 48 are connected with each other, and contacts 46 and 50 are disconnected from each other. When coil 38 is energized, contacts 40 and 42 are disconnected, and contacts 40 and 44 are connected. Likewise, energization of coil 38 causes disconnection of contacts 46 and 48 and connection of contacts 46 and 50.

Relay contact 40 is connected with ground. Contacts 42 and 48 are connected with a line 52 which leads to the magneto 12 of the ignition system. In an alternative embodiment, wire 52 is connected only to contact 42. In this alternate embodiment, the magneto 12 and the regulator/rectifier are not connected to one another and the regulator/rectifier 14 is left in an unpowered state during the "stop" mode/function. Contact 44 connects with a line 54 which controls another relay that will be described more fully. Contact 46 connects with a line 56 that leads to the regulator/rectifier 14. Contact 50 connects with another line 58.

Each time the receiver/controller 26 activates the first output line 32, it also activates the second output line 34 which extends to a starter timer circuit 60 that receives power from the power source 30. Circuit 60 has an output line 62 to which it applies a timed negative pulse that is activated for an adjustable time period every other time a signal is received by the receiver/controller 26. The duration of the pulse signal on line 62 can be adjusted by suitably adjusting the timer circuit 60. Preferably, the pulse is adjustable to any duration between zero and 20 seconds, and the duration will normally be set between 1 and 8 seconds.

The pulse signal on line 62 is applied to a relay which is generally identified by numeral 64. Relay 64 has a coil 66 which is energized via a circuit which includes coil 66, the power source 30 and line 62 during the time that the pulse is present on line 62.

Relay 64 is shown in the deenergized condition of coil 66. Then, relay contacts 68 and 70 are connected with one another and contacts 68 and 72 are disconnected. Conversely, when coil 66 is energized, contacts 68 and 70 are disconnected and contacts 68 and 72 are connected. The power source 30 is connected through line 74 with contact 68. Line 58 connects contact 50 of relay 36 with contact 70 of relay 64. Contact 72 is connected with the start solenoid 16 through line 76.

The control circuitry includes a third relay which is generally identified by numeral 78. Relay 78 has a coil 80 which is connected with line 54 on one side and with the power source 30 on the other side. In the deenergized condition of coil 80 shown in the drawing, relay contact 82 is connected with contact 84 and disconnected from contact 86. When coil 80 is energized, contacts 82 and 86 are connected and contacts 82 and 84 are disconnected. Contact 82 connects with the fuel shut-off solenoid 18 through line 88. Contact 84 is isolated. The third contact 86 is connected with the power source 30.

In operation, the operational systems of an engine with a magneto ignition 10 may be remotely operated to start the engine by pressing the button 22 once to generate a first signal from the transmitter 20. The operator of the transmitter may be up to 500 feet away from the receiver/controller 26 and still provide a signal that is received by the receiver under most conditions. Even when there is an intervening barrier, the transmitter 20 is effective to provide a signal to the receiver up to several hundred feet. It is again noted that the transmitter and receiver are matched through digital coding so that the receiver 26 is not activated by extraneous signals but only by signals that are validated as originating as pulses from the transmitter 20.

When the first signal is received by the receiver/controller 26, both output lines 32 and 34 are activated simultaneously. Activation of line 32 is continuous and results in energization of the relay coil 38. Relay contacts 46 and 48 are then disconnected to disconnect the magneto 12 and regulator/rectifier 14 from one another, and contacts 40 and 42 are disconnected to disconnect the magneto 12 and regulator/rectifier 14 from ground. In the alternative embodiment where wire 52 is connected only to contact 42, contacts 42 and 40 disconnect and thereby disconnect the magneto 12 from ground. Relay contacts 40 and 44 are connected in order to energize coil 80 of relay 78 by providing a ground path on one of its sides. Energization of coil 80 connects relay contacts 82 and 86 to supply power from the power source 30 through the relay contacts and line 88 to the fuel shut-off solenoid 18.

The signal on line 34 results in activation of line 62 for the set time period set on the starter timer circuit 60. This energizes coil 66 of relay 64 for the duration of the pulse on line 62. When coil 66 is energized, relay contacts 68 and 72 are connected to supply power from the power source 30 through line 74, relay contacts 68 and 72, and line 76 to the start solenoid 16. For the duration of the pulse on line 62, the regulator/rectifier 14 is disconnected from the power source 30 due to the disconnection of relay contacts 68 and 70.

Thus, when an initial radio frequency signal from the transmitter 20 is received and validated by the receiver/controller 26, the start solenoid 16 and the fuel shut-off solenoid 18 are supplied with power, and the magneto 12 and the regulator/rectifier 14 are disconnected from one another and from ground or the magneto 12 is disconnected from ground and the regulator/rectifier 14 is left in an unpowered state. This condition is one in which the operation systems of an engine with a magneto ignition 10 is able to start the engine.

After the set time period of the circuit 60 has elapsed, the pulse on line 62 disappears and coil 66 is deenergized. Then, contacts 68 and 72 are disconnected to remove power from the start solenoid 16. Thus, once the engine has been started, power to the start solenoid is removed exactly as would occur when the key of a key operated ignition is moved to the "start" position to start the engine and is thereafter allowed to move to the "run" position once the engine has started.

After the set time period of the pulse on line 62 has elapsed and coil 66 is deenergized, contacts 68 and 70 are connected. Then, power is applied from the power source 30 through line 74, contacts 68 and 70, line 58, contacts 50 and 46, and line 56 to the regulator/rectifier circuit 14. This allows the engine to run because power is supplied to the regulator/rectifier 14 and to the fuel shut-off solenoid 18, while the magneto 12 and the start solenoid 16 are disconnected from power.

The operator can stop the engine from a remote position by again pressing the button 22 to transmit another signal from the transmitter 20 to the receiver/controller 26. Upon receipt of this second valid signal, the receiver/controller 26 deactivates both output lines 32 and 34. The latching coil 38 is then deenergized, and coil 80 is deenergized because the ground path on one of its sides is interrupted by disconnection of relay contacts 40 and 44. All relays are then deenergized. The start solenoid 16 and the fuel shut-off solenoid 18 are both disconnected from the power source 30. Magneto 12 and the regulator/rectifier 14 are connected with one another through contacts 46 and 48 and are connected with ground through contacts 40 and 42 or, in the alternative embodiment where line 52 is connected only to contact 42, contacts 42 and 40 connect the magneto 12 to ground, leaving the regulator/rectifier 14 in an unpowered state. Consequently, the operating systems of an engine with a magneto ignition 10 stops the engine.

The next signal received by the receiver/controller 26 causes the engine to start in the manner described previously. It is thus apparent that alternating signals from the transmitter serve as alternating start and stop signals which start and stop the engine.

In the case when the ignition switch is an active component in the control circuit all functions of the regulator/rectifier and the fuel shut-off solenoid are controlled by leaving the ignition switch in the "run" position as outlined in diagram 2. The start/stop sequence functions of the magneto and the start solenoid are then controlled by the control circuit as previously described. It should be noted that this configuration is merely a subset of the control circuit previously described.

In this manner, the operational systems of an engine with a magneto ignition 10 can be controlled from a remote location in a simple manner that requires only alternating depressions of the control button 22. This is to be contrasted with a system in which multiple buttons must be pushed in a prescribed sequence in order to transmit control signals. It is again pointed out that the digital coding which matches the transmitter 20 with its mating receiver/controller 26 assures that stray signals will not falsely activate the control circuitry.

The remote control system for starting engines with magneto ignitions is applicable in a wide variety of situations where it is desirable for the operator to remain at a location remote from the location of the engine and yet still have the need to start and stop the engine from time to time. For example, in the operation of spray painting systems, the operator may be located well away from the engine which powers the spray pump, and yet he must turn the engine off and on at times. Rather than requiring him to move to the location of the engine each time he wants to start or stop it, and then move back to where he is working, it is much more convenient and efficient to utilize the remote control system of the present invention for starting and stopping of the engine. The remote control system of the present invention allows the operator to start or stop the engine autonomously without modulated inputs from the transmitter. This is especially convenient when the engine is either out of sight or at a distance where it cannot be heard. Other contemplated applications include welding machines, pressure washing equipment, insecticide pumps, lawn chemical application pumps, insulation blowing pumps, carpet cleaning systems, and any other type of equipment which involves the operator needing to start or stop an engine with a magneto ignition from a remote location.

While the system has been shown and described using relays for the control functions, solid state switching and other known controls can be used instead. Also, the control circuit can perform its necessary functions in other ways that are known in the art.

It should be understood that the transmitter only requires a single unmodulated press of the control button on the transmitter to transmit a signal recognizable by the receiver. The signal is preferably a radio pulse. The receiver is only capable of recognizing the signal transmitted by its matching transmitter. This is to prevent stray signals, even from other like transmitters, from triggering the start or kill sequence for this particular engine with a magneto ignition.

In an alternate embodiment, the time period for applying power to said start solenoid is not only adjustable but may be automatically adjusted by the sensing of an engine start condition. The adjustable length of the pulse used in the control circuit to energise the relay when applying power to the start solenoid may also be adjusted automatically by the sensing off an engine start condition.

In another alternate embodiment, instead of having to disconnect the magneto from ground and from the regulator/rectifier in an energized condition and connected to ground and the regulator/rectifier in a deenergized condition to maintain the magneto in an ungrounded condition, one can simply disconnect the magneto from ground only in the energized condition and connect it to to ground only in the deenergized condition if wire 52 is only connected to contact 42. If wire 52 is only connected to contact 42 and not to both contacts 42 and 48, the regulator/rectifier need not be connected or disconnected as described but may be left in an unpowered state.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. Apparatus for remotely starting an engine with a magneto ignition having a regulator/rectifier, a magneto, a start solenoid and an fuel shut-off solenoid, said apparatus comprising:

a transmitter for transmitting a radio frequency signal;

a receiver located remotely from said transmitter for receiving said signal;

means for autonomously applying power to said start solenoid for a selected time period following receipt of said signal by the transmitter and removing power from the start solenoid after said time period has elapsed;

means for autonomously applying power to said fuel shut-off solenoid upon receipt of said signal by the transmitter;

means for autonomously applying power to said regulator/rectifier following elapse of said time period; and means for autonomously maintaining said magneto in an ungrounded condition to allow the engine to start during said time period and to run thereafter.

2. Apparatus as set forth in claim 1, wherein said selected time period is adjustable.

3. Apparatus as set forth in claim 1, wherein said means for applying power to said start solenoid comprises:

a control circuit;

a relay in said control circuit having an energized condition wherein power is applied to the start solenoid by said control circuit and a deenergized condition wherein the control circuit disconnects power from the start solenoid; and means in said control circuit for applying a pulse effective to energize said relay, said pulse being present for said time period after said signal has been received by said receiver.

4. Apparatus as set forth in claim 3, wherein the duration of said pulse is adjustable to adjust the length of said time period.

5. Apparatus as set forth in claim 1, wherein said means for maintaining said magneto in an ungrounded condition comprises:

a control circuit;

a first relay in said control circuit having an energized condition wherein said magneto is disconnected from ground and from said regulator/rectifier and a deenergized condition wherein said magneto is connected to ground and to said regulator/rectifier; and means in said control circuit for applying power effective to energize said first relay upon receipt of said signal by the receiver and to maintain said first relay in the energized condition thereafter until another signal is received.

6. Apparatus as set forth in claim 5, wherein said means for applying power to said start solenoid comprises:

a second relay in said control circuit having an energized condition wherein power is applied to the start solenoid by said control circuit and a deenergized condition wherein the control circuit disconnects power from the start solenoid; and means in said control circuit for applying a pulse effective to energize said second relay, said pulse being present for said time period after said signal has been received by said receiver.

7. Apparatus as set forth in claim 6, wherein said means for applying power to said fuel shut-off solenoid comprises:

a third relay in said control circuit having an energized condition wherein said control circuit applies power to said fuel shut-off solenoid and a deenergized condition wherein said control circuit disconnects power from said fuel shut-off solenoid; and means in said control circuit for energizing said third relay when said first relay is energized and deenergizing said third relay when said first relay is deenergized.

8. Apparatus as set forth in claim 7, wherein said means for applying power to said regulator/rectifier comprises means in said control circuit for connecting said regulator/rectifier with a power source in said control circuit when said first relay is energized and said second relay is deenergized.

9. Apparatus as set forth in claim 6, wherein said means for applying power to said regulator/rectifier comprises means in said control circuit for connecting said regulator/rectifier with a power source in said control circuit when said first relay is energized and said second relay is deenergized.

10. Apparatus for remotely controlling the starting and stopping of an engine with a magneto ignition having a regulator/rectifier, a magneto, a start solenoid and an fuel shut-off solenoid, said apparatus comprising:

a transmitter for transmitting radio frequency start and stop signals;

a receiver located remotely from said transmitter for receiving said start and stop signals;

means for autonomously applying power to said start solenoid for a selected time period following receipt of said start signal by the transmitter and thereafter removing power from the start solenoid;

means for applying power to said fuel shut-off solenoid upon receipt of said start signal by the transmitter;

means for isolating said regulator/rectifier from a grounded condition during said time period and thereafter applying power to said regulator/rectifier;

means for maintaining said magneto in an ungrounded state following receipt of said start signal, thereby allowing the engine to start during said time period and to run thereafter prior to receipt of said stop signal;

means for grounding said regulator/rectifier and said magneto upon receipt of said stop signal; and means for discontinuing the application of power to said fuel shut-off solenoid upon receipt of said stop signal, whereby the engine stops when the stop signal is received.

11. Apparatus as set forth in claim 10, wherein said means for applying power to said start solenoid comprises:

a control circuit which includes a source of power and a relay having energized and deenergized conditions;

means in said control circuit for connecting said start solenoid with said source of power in the energized condition of said relay;

means in said control circuit for disconnecting said start solenoid from said source of power in the deenergized condition of said relay; and means in said control circuit operable when said start signal is received for applying to said relay a pulse having a duration equal to said time period, thereby energizing said relay for said time period.

12. Apparatus as set forth in claim 11, wherein said means for applying power to said fuel shut-off solenoid comprises another relay in said control circuit having an energized condition wherein said power source is connected to the fuel shut-off solenoid and a deenergized condition wherein said power source is disconnected from the fuel shut-off solenoid, and means in said control circuit for maintaining said other relay energized between receipt of said start signal and receipt of said stop signal.

13. Apparatus as set forth in claim 10, wherein said means for maintaining said magneto in an ungrounded state comprises:

a control circuit which includes a power source and a first relay having energized and deenergized conditions;

means in said control circuit for grounding said magneto when said first relay is in the deenergized state;

means in said control circuit for disconnecting said magneto from a grounded state in the energized state of said first relay; and means in said control circuit operable upon receipt of said start signal for maintaining said first relay in the energized condition.

14. Apparatus as set forth in claim 13, wherein:

said control circuit includes means for connecting said magneto and regulator/rectifier to one another and to ground in the deenergized condition of said first relay; and said means for grounding said regulator/rectifier and said magneto comprises means for effecting the deenergized condition of said first relay upon receipt of said stop signal.

15. Apparatus as set forth in claim 14, wherein said means for applying power to said start solenoid comprises:

a second relay in said control circuit having energized and deenergized conditions;

means in said control circuit for connecting said start solenoid with said power source in the energized condition of said second relay;

means in said control circuit for disconnecting said start solenoid from said power source in the deenergized condition of said second relay; and means in said control circuit operable when said start signal is received for applying to said second relay a pulse having a deviation equal to said time period, thereby energizing said second relay for said time period.

16. Apparatus as set forth in claim 15, wherein said means for isolating said regulator/rectifier from a grounded condition during said time period and thereafter applying power to said regulator/rectifier comprises:

means for isolating said regulator/rectifier from ground and from said magneto in the energized condition of said first relay; and means for connecting said regulator/rectifier with said power source when said first relay is energized and said second relay is deenergized.

17. Apparatus as set forth in claim 15, wherein the duration of said pulse is adjustable to adjust the length of said time period.

18. Apparatus as set forth in claim 10, wherein said time period is adjustable.

19. In combination with a transmitter for transmitting radio frequency start and stop signals and a receiver located remotely from the transmitter for receiving the start and stop signals, a control circuit for remotely starting and stopping an engine with a magneto ignition having a regulator/rectifier, a magneto, a start solenoid and an fuel shut-off solenoid, said control circuit comprising:

a first relay having energized and deenergized conditions, said regulator/rectifier and said magneto being connected with one another and with ground in the deenergized condition of said first relay and being disconnected from one another and from ground in the energized condition of said first relay;

means for effecting the energized condition of said first relay when said start signal is received and maintaining the energized condition thereof until said stop signal is thereafter received to effect the deenergized condition of said first relay;

a second relay having energized and deenergized conditions, said start solenoid receiving power in the energized condition of said second relay and being disconnected from power in the deenergized condition thereof;

means for energizing said second relay for a selected time period after said start signal has been received and deenergizing said second relay after said time period has elapsed, said regulator/rectifier receiving power only when said first relay is energized and said second relay is deenergized;

a third relay having energized and deenergized conditions in which said fuel shut-off solenoid receives power and is disconnected from power, respectively; and means for energizing said third relay when the first relay is energized and deenergizing said third relay when the first relay is deenergized.

20. A control circuit as set forth in claim 19, wherein said time period is adjustable.

* * * * *